United States Patent [19]

Sokolowski

[11] Patent Number: 4,734,311

[45] Date of Patent: Mar. 29, 1988

[54] ELASTICIZED NON-WOVEN FABRIC AND METHOD OF MAKING THE SAME

[75] Inventor: Robert C. Sokolowski, Menasha, Wis.

[73] Assignee: Kimberly-Clark Corporation, Neenah, Wis.

[21] Appl. No.: 772,598

[22] Filed: Sep. 4, 1985

Related U.S. Application Data

[63] Continuation of Ser. No. 692,231, Jan. 16, 1985, abandoned.

[51] Int. Cl.[4] ..... D06N 7/04

[52] U.S. Cl. ..... 428/152; 428/288; 428/903; 428/910

[58] Field of Search ..... 428/229, 230, 288, 198, 428/360, 370, 152, 910, 903; 156/85, 161, 244.23

[56] References Cited

U.S. PATENT DOCUMENTS

| | | | |
|---|---|---|---|
| 2,539,301 | 1/1951 | Foster | 28/73 |
| 2,623,031 | 12/1952 | Snyder | 260/45.4 |
| 2,703,774 | 3/1955 | Morrison | 154/128 |
| 3,214,323 | 10/1965 | Russell | 161/148 |
| 3,315,328 | 4/1967 | Ibrahim | 28/72 |
| 3,353,345 | 11/1967 | Setzer | 57/140 |
| 3,359,610 | 12/1967 | Faircloth | 28/72 |
| 3,510,389 | 5/1970 | Olson | 428/296 |
| 3,551,271 | 12/1970 | Thomas | 161/150 |
| 3,622,434 | 11/1971 | Newman | 156/183 |
| 3,639,917 | 2/1972 | Althouse | 2/270 |
| 3,917,448 | 11/1978 | Wood | 428/114 |
| 4,100,324 | 7/1978 | Anderson | 428/288 |
| 4,107,364 | 8/1978 | Sisson | 428/196 |
| 4,209,563 | 6/1980 | Sisson | 428/288 |
| 4,426,420 | 1/1984 | Likhyani | 428/224 |
| 4,467,595 | 8/1984 | Kramers | 264/176 F |
| 4,486,485 | 12/1984 | Sookne | 428/198 |
| 4,515,854 | 5/1985 | Kogame et al. | 428/288 |
| 4,551,378 | 11/1985 | Carey | 428/198 |
| 4,554,121 | 11/1985 | Kramers | 428/196 |

FOREIGN PATENT DOCUMENTS

| | | |
|---|---|---|
| 790500 | 7/1968 | Canada . |
| 0125494A2 | 10/1984 | European Pat. Off. . |
| 979103 | 1/1965 | United Kingdom . |
| 996874 | 6/1965 | United Kingdom . |
| 1121686 | 7/1968 | United Kingdom . |
| 1134044 | 11/1968 | United Kingdom . |
| 1208785 | 10/1970 | United Kingdom . |
| 1349504 | 4/1974 | United Kingdom . |
| 1477809 | 6/1977 | United Kingdom . |

*Primary Examiner*—James J. Bell

*Attorney, Agent, or Firm*—Joseph P. Harps

[57] ABSTRACT

An elasticized non-woven fiber material is made by combining one or more textile fibers with one or more elasticizeable fibers and bonding the combined fibers together. The resultant web of bonded non-woven fibers is then heat-treated to heat-shrink the elasticizeable fiber and recover its elasticity thereby shrinking the fibers and the web of material. An elasticized non-woven fabric made by the described method is also provided.

18 Claims, No Drawings

ELASTICIZED NON-WOVEN FABRIC AND METHOD OF MAKING THE SAME

This application is a continuation application of application Ser. No. 692,231, filed on Jan. 16, 1985, now abandoned.

BACKGROUND OF THE INVENTION

1. Field of the Invention

The present invention concerns non-woven fiber materials, in particular elasticized non-woven fiber materials and a method of making such materials.

2. Description of Related Art

The manufacture of elasticized non-woven fiber materials by the technique of combining conventional textile fibers with elasticizeable fibers and heat-treating the fabric to elasticize the elasticizeable fibers is shown in U.S. Pat. No. 4,426,420 (Likhyani). This patent discloses the preparation of non-woven batts comprising a so-called "hard fiber" and "potentially elastic" fiber. The hard fibers are described as comprising any synthetic or natural fiber forming material such as polyesters, polyamides, etc., or natural fibers such as cotton, silk, paper, etc. The potentially elastic fibers are stated to be elastomeric compositions of the type which are elasticized by heat-treatment. The Likhyani patent discloses a method for making a so-called "spunlaced" non-woven fabric wherein a batt composed of at least two types of staple fibers is subjected to hydraulic entanglement by fine, high pressure columnar streams of water which entangle the fibers to provide the spunlaced material. After the entanglement, the resultant fabric is heat-treated to develop elastic characteristics in the elastomeric fibers. The elastomeric filaments are extruded, cold-drawn and cut to desired fiber length as described in the sole example of the patent.

SUMMARY OF THE INVENTION

In accordance with the present invention there is provided a method for making a non-woven elasticized fiber material which comprises combining, blending or intermixing at least one type of textile fiber with at least one type of uniaxially oriented elasticizeable fiber, bonding the combined fibers to each other to form a web, matrix, sheet or the like, and heating the resultant web to heat-shrink the oriented fiber which thereby resumes or recovers its elastic properties. The resultant web thereby exhibits elastomeric properties.

One aspect of the invention includes combining about 1% to 50%, preferably 5% to 35%, by weight of the elasticizeable fiber with about 99% to 50%, preferably 95% to 65%, by weight of the textile fiber.

In another aspect of the invention the elasticizeable fiber comprises an extruded synthetic elastomeric polymer, and the method includes the steps of cold-drawing an elasticizeable filament to uniaxially orient the filament to stretch it by at least about 100%, preferably about 100% to 500%, of its initial length, then cutting to preform filaments to a desired fiber length. This fiber is combined with, and bonded to, the textile fiber while the elasticized fiber is in its oriented condition to form a suitable web.

In accordance with the invention, the resultant web is heat-shrunk, preferably at a temperature of about 75° C. to 200° C., to shrink the oriented fiber to about 10% to 90% of its elongated length.

Another aspect of the invention includes combining at least one type of textile fiber, at least one type of melt blown fiber and at least one type of elasticizeable fiber to form the fiber material web. In certain aspects of the invention the elasticizeable fiber is selected from the group consisting of styrene-butadiene copolymers, styrene-butadiene-styrene copolymers and polyurethane.

In accordance with the invention, there is also provided an elasticized non-woven fiber material comprising at least one type of textile fiber bonded to at least one type of elastic fiber obtained by heat-treatment of an oriented preform, the textile fiber being retracted and pleated upon heat-shrinking of the preform to elasticize the elastic fiber but the textile fiber being sufficiently free to extend to about its original tension level upon being stretched. The fiber material may further include at least one type of metal blown fiber.

DESCRIPTION OF THE PREFERRED EMBODIMENTS

Non-woven fabrics are of course well known in the art and generally comprise textile fibers, which may be of varying length from very short fibers to very long or substantially continuous fibers, which have been combined to form a web or batt of non-woven fabric. As used herein and in the claims the term "textile fiber" is intended to broadly include any fiber which is useful in making a non-woven fabric. Such fibers may be made of synthetic organic polymeric materials, processed natural materials or a combination thereof. By way of illustration and without limitation, synthetic polymeric fibers which are useful as textile fibers in the present invention include polyester fibers, polyamide fibers such as nylon, acrylic polymer and copolymer fibers, glass fibers, polyolefin fibers such as polyethylene and polypropylene fibers, cellulosic derivatives such as rayon, and combined fibers such as fibers of one material sheathed with a casing of another material. For example, polypropylene fibers sheathed with polyethylene are known in the art. Fibers made from processed natural materials, i.e., natural fibers, which are useful as textile fibers in the present invention include, without limitation, cotton, silk, wool, pulp or paper and the like as well as blends or combinations of any two or more of the foregoing fibers. Such textile fibers are usually distinguished in the art from elastic fibers as the textile fibers generally have extremely limited elasticity characteristics. That is, they usually would elongate no more than 40%, usually 20% to 40% of their initial length before breaking and generally have a modulus of elasticity in the range of about 18 to 85 grams per denier, but may be higher.

As used herein and in the claims, the term "elasticizeable fiber" has reference to those materials, usually synthetic polymeric elastomeric materials, which (a) can be extruded into filaments, (b) be drawn, usually at ambient temperature (cold-drawn) to elongate, stretch or orient the filaments, which will retain their stretched condition upon being relaxed by release of the drawing tension, and (c) upon being heated to an elevated temperature the tensioned material will markedly shrink and thereby recover or resume its elastomeric property. By being "elasticized" it is meant that the heat-shrunk fibers will be able to be stretched to all or nearly all of their relaxed, pre-heated elongated length and return to approximately their heat-shrunk length upon release of the stretching force. Preferably, the stretched filament is cut to desired fiber length, which length will depend upon such factors as the particular process employed or the end use of the material. Prior to elasticization, the elasticizeable fibers can be air-laid, carded or otherwise formed into non-woven webs in substantially the same manner as textile fibers.

By "cold-drawing" as used herein and in the claims is meant the technique of drawing or stretching the elastomeric filament or preform when it has cooled to substantially below its extrusion temperature, usually when it has cooled to ambient temperature. Such drawing is conventionally utilized to strengthen and reduce the diameter of the extruded fiber. The cold-drawing as utilized in the present invention is carried out at a temperature below the extrusion temperature, preferably at ambient temperature, and the cold-drawing is preferably carried out to an extent to elongate the fiber by about 100% to 500% or more, e.g., 1,000%, but usually about 100% to 400% of its initial length.

In the practice of the present invention, the elasticizeable fiber is combined with the textile fiber, and may optionally be combined with other materials such as melt blown fibers, by any suitable technique such as dry-laid, wet-laid or carding techniques and the combined fibers are then bonded by any suitable technique which will not heat the elongated elasticizeable fibers so as to shrink them since, in accordance with the invention, heat-shrinking of the elasticizeable fibers is carried out after they are bonded to the textile fibers or the textile and melt blown fibers. Thus, adhesive, e.g., latex spray bonding, sonic wave bonding, or any combination of suitable techniques may be employed, so long as the elasticizeable fiber shrinking temperatures are avoided until the bonding operation is carried out. The result is a shrinkable, that is, a heat-shrinkable, fiber material in which the shrinking of the elasticizeable fibers will shrink the web of bonded elasticizeable and textile fibers. A preferred method of bonding is to spray a light coating of any suitable adhesive, such as a latex, e.g., a urethane latex, onto the web of combined fibers. The fibers may be combined in any suitable way and, as used herein and in the claims, the term "adhesive" is used broadly to mean any material which will bond the combined fibers one to the other and is otherwise suitable for the purposes of the invention. The adhesive or sonic bonding is preferred as it physically joins the fibers, not merely by frictional entanglement, so that the heat-treatment to shrink and thereby elasticize the elasticizeable fiber relaxes the textile fibers so that they do not impede stretching of the elasticized fibers. The web of fiber material after heat-treatment will be reduced in its length and width dimensions.

After the combined fibers are bonded together, the resultant fiber material web is heated by any suitable means such as being passed through an oven, under heating lamps, infra red radiation, or the like, in order to heat the elasticizeable fibers sufficiently to shrink them to impart the desired elastic characteristics thereto. The fiber material containing the elasticizeable fibers is in a relaxed condition during the heating step to allow contraction.

A significant advantage provided by the technique of the invention is that inasmuch as the elasticizeable fibers are oriented when they are bonded to the textile fibers, upon shrinking of the former the textile fibers bonded thereto will retract and loop or pleat as the elasticizeable fibers contract. Consequently, when the finished fabric is stretched, even if it is stretched to a degree which returns the now elasticized fibers to their original pre-shrunk length, there is sufficient play in the textile fibers that they do not restrain stretching of the fabric. In other words, maximum stretching of the elasticized fibers, even to their pre-shrunk length, will extend the textile fibers only to the tension level they were at when they were bonded to the unshrunken elasticizeable fibers. This contributes greatly to the comfort and stretchability of the non-woven fabric of the invention.

The elasticizeable fibers useful in the invention may be any suitable fiber, as described above. One elasticizeable fiber found to be useful is sold under the trademark KRATON by Shell Chemical Company and another is sold under the trademark ESTANE by B. F. Goodrich Company. Other suitable compositions are those disclosed in U.S. Pat. Nos. 3,007,227, 3,651,014, 3,766,143, and 3,763,109, the respective disclosures of which are incorporated by reference herein. The ESTANE elasticizeable fiber is a urethane polymer and the KRATON elasticizeable fiber is a styrene-butadiene-styrene copolymer.

The following examples illustrate specific embodiments of the invention.

EXAMPLE.1

Several grades of urethane elasticizeable polymers sold under the trademark ESTANE by Shell Chemical Company and several grades of styrene-butadiene-styrene elasticizeable polymer sold under the trademark KRATON by B. F. Goodrich company were extruded into filaments. The extruder had four heat zones along the screw, typically maintained at respective temperatures of 148.9° C., 168.3° C., 176.7° C. and 182.2° C. in the direction of extrusion. The die comprised eight openings of 10 mil diameter each and a die pressure of from 3,500 to 5,500 psi was utilized. After cooling to ambient temperature, the extruded filaments were cold-drawn over rollers with the following typical results, dependent on specific extrusion conditions:

TABLE I

| Elasticizeable Polymer | (a) | (b) | (c) | (d) |
|---|---|---|---|---|
| ESTANE 5707 | 8,000 | 122.11 | 0.616 | 308 |
| ESTANE 5710 | 7,000 | 135.18 | 0.341 | 254 |
| KRATON 1102 | 4,600 | 390.3 | 0.198 | 1085 |
| KRATON 3200 | 1,700 | 139.8 | 0.076 | 268 |

(a) = Nominal tensile strength PSI
(b) = Denier per filament
(c) = Tensile strength, grams per denier
(d) = % elongation to breakage The percentage elongations to breakage show highly elastic fibers which, after heat treatment, are shrinkable to a fraction of their elongated length and elastic between approximately their heat-shrunk and elongated lengths.

EXAMPLE 2

A four-ply supercrimp nylon fiber was formed into a carded web and stretched, elasticizeable fibers made of KRATON 3200 copolymer extruded as described above were air-laid onto the carded nylon. The elasticizeable fibers had a denier of 139.7 8, 0.076 grams per denier and an elongation to breakage of 268%. The fiber content of the finished web comprised 60% by weight elasticizeable fiber and 40% by weight nylon. Upon heating, the web of fiber material showed shrinkage and corresponding elasticity as follows:

| Heating Temperature | % Shrinkage of Web | | |
|---|---|---|---|
| | 80° C. | 120° C. | 150° C. |
| Sample | | | |
| 1 | 29 | 35 | 44 |
| 2 | 30 | 37 | 45 |
| 3 | 29 | 33 | 43 |

EXAMPLE 3

A bonded web was prepared from 1.5 parts by weight Enka Rayon 700 1 9/16 inch staple fibers, 1.5 parts by weight 1 9/16 inch polypropylene staple fibers and 12 parts by weight KRATON 3200 elasticizeable fiber of Example 2. A urethane binder liquid was sprayed onto the web in a pattern of nearly touching ⅛ inch diameter dots by use of a spray template. The urethane binder comprised 80% by weight of the finished bonded web. Upon heating at 120°-130° C., the web of fiber material sustained 38% shrinkage.

EXAMPLE 4

A bonded web was prepared from 4 parts by weight polypropylene 1 9/16 inch staple fibers, 9 parts by weight KRATON 3200 fibers per Example 2 cut to 1 9/16 inch staple length, and the cmbined fibers were bonded with a pattern of five dots of urethane binder so that the finished web comprised 70% by weight of urethane binder. Upon heating to 120°-130° C., the web of fiber material showed a shrinkage of 65%.

The fiber webs of the invention show excellent elasticity as stretchability unhampered by the limited stretchability of the textile fibers. This follows from the above-described method of bonding the elasticizeable fibers in their elongated, pre-shrunk state to the textile fibers in a shrinkable web.

While the invention has been described in detail with respect to specific preferred embodiments thereof it will be appreciated that upon a reading and understanding of the foregoing variations and modifications to the preferred embodiments will occur to those skilled in the art and such variations and modifications are believed to fall within the spirit and scope of the invention and the appended claims.

What is claimed is:

1. A fibrous elastomeric non-woven web comprising:

a plurality of textile fibers having a modulus of elasticity of about 18 to 85 grams per denier which are gathered and pleated; and a plurality of heat shrunk elasticized fibers consisting essentially of an elasticized material with at least some of the elasticized fibers being bonded to at least some of the textile fibers.

2. The web according to claim 1, which further includes a plurality of melt blown fibers.

3. A fibrous non-woven web comprising:

a plurality of textile fibers having a modulus of elasticity of about 18 to 85 grams per denier; and a plurality of uniaxially oriented heat shrinkable elasticizable fibers consisting essentially of an elasticizable material with at least some of the elasticizable fibers being bonded to at least some of the textile fibers; and wherein said elasticizable heat shrinkable fibers are adapted to shrink to effect gathering and pleating of said textile fibers upon application of heat to the web.

4. The web according to claim 3, which further includes a plurality of melt blown fibers.

5. The web according to claim 1, comprising from about 5 percent to about 35 percent, by weight, of the elasticizable fibers and from about 65 percent to about 95 percent, by weight, of the textile fibers.

6. The web according to claim 1, wherein said elasticizable fibers are selected from the group consisting of styrene-butadiene copolymers, styrene-butadiene-styrene copolymers and polyurethanes.

7. The web according to claim 1, wherein said textile fibers are selected from the group consisting of polyester fibers, polyamide fibers, glass fibers, polyolefin fibers, cellulosic derived fibers, acrylic polymer and copolymer fibers, natural fibers and blends of two or more types of said textile fibers.

8. The web according to claim 7, wherein said polyamide fibers are selected from the group consisting of nylon fibers and acrylic polymer and copolymer fibers.

9. The web according to claim 7, wherein said polyolefin fibers are selected from the group consisting of polyethylene fibers and polypropylene fibers.

10. The web according to claim 7, wherein said cellulosic derived fibers are rayon fibers.

11. The web according to claim 7, wherein said natural fibers are selected from the group consisting of cotton fibers, wool fibers, pulp fibers, paper fibers and blends of two or more of said natural fibers.

12. The web according to claim 3, comprising from about 5 percent to about 35 percent, by weight, of the elasticizable fibers and from about 65 percent to about 95 percent, by weight, of the textile fibers.

13. The web according to claim 3, wherein said elasticizable fibers are selected from the group consisting of styrene-butadiene copolymers, styrene-butadiene-styrene copolymers and polyurethanes.

14. The web according to claim 3, wherein said textile fibers are selected from the group consisting of polyester fibers, polyamide fibers, glass fibers, polyolefin fibers, cellulosic derived fibers, acrylic polymer and copolymer fibers, natural fibers and blends of two or more types of said textile fibers.

15. The web according to claim 14, wherein said polyamide fibers are selected from the group consisting of nylon fibers.

16. The web according to claim 14, wherein said polyolefin fibers are selected from the group consisting of polyethylene fibers and polypropylene fibers.

17. The web according to claim 14, wherein said cellulosic derived fibers are rayon fibers.

18. The web according to claim 14, wherein said natural fibers are selected from the group consisting of cotton fibers, wool fibers, pulp fibers, paper fibers and blends of two or more of said natural fibers.

* * * * *